US005346036A

United States Patent [19]

Arisman et al.

[11] Patent Number: 5,346,036

[45] Date of Patent: Sep. 13, 1994

[54] ROOF LIFELINE ANCHOR

[75] Inventors: Mark Arisman, Pheonix; Mike Tomer, Baltimore; Terry Jermolojevs, Columbia; Bill Eyler, Myersville, all of Md.; Dave Tate, Richmond; Greg Morgan, Woodbridge, both of Va.; John Aldous, Ellicott City, Md.

[73] Assignee: Ryland Homes, Columbia, Md.

[21] Appl. No.: 31,480

[22] Filed: Mar. 15, 1993

[51] Int. Cl.[5] ..... A62B 35/00

[52] U.S. Cl. ..... 182/3; 248/200.1; 248/343

[58] Field of Search ..... 182/45, 3–5, 182/6, 7; 248/342, 343, 200.1, 340, 300, 237, 172; 52/37, 39

[56] References Cited

U.S. PATENT DOCUMENTS

| | | | |
|---|---|---|---|
| 2,703,688 | 3/1955 | Shuter | 248/237 |
| 3,217,833 | 11/1965 | Smith | 182/3 |
| 3,955,511 | 5/1976 | Bak | 248/172 X |
| 4,249,713 | 2/1981 | Glynn et al. | 182/3 X |
| 4,928,790 | 5/1990 | Franks | 182/3 |
| 5,011,106 | 4/1991 | Cody | 182/3 X |
| 5,036,949 | 8/1991 | Crocker et al. | 182/3 |
| 5,054,576 | 10/1991 | Glynn | 182/3 |
| 5,092,426 | 3/1992 | Rhodes | 182/3 |
| 5,148,890 | 9/1992 | Sipe | 248/237 X |
| 5,248,021 | 9/1993 | Nichols | 182/3 |

FOREIGN PATENT DOCUMENTS

| | | | |
|---|---|---|---|
| 57004 | 12/1912 | Austria | 182/45 |
| 2219826 | 12/1989 | United Kingdom | 182/45 |

*Primary Examiner*—Karen J. Chotkowski

*Attorney, Agent, or Firm*—Sherman and Shalloway

[57] ABSTRACT

The invention provides a roof lifeline anchor device for attachment to and between adjacent roof trusses of a building. The anchor comprises an elongated beam having roof truss attachment structure located at each end and a lifeline attachment structure centrally located along the beam. The device attaches to roof trusses in such a manner that forces exerted on lifelines connected thereto will be directed through the anchor into the truss assemblies and be spread across two or more trusses. In the preferred embodiment, the device is fabricated from a steel box beam and the truss attachments are stirrups fabricated from sheet steel sized to fit over the beams of a roof truss. This preferred form is fitted to the truss assemblies from beneath and secured to the trusses by bolts passing through the stirrups and the truss beams so that forces on the lifelines tend to pull the anchor upward against the truss beams.

24 Claims, 6 Drawing Sheets

ROOF LIFELINE ANCHOR

BACKGROUND OF THE INVENTION

Workplace safety regulations require that workers in certain situations be secured by protective lifelines. In the building construction industry, the problem is often the provision of an adequate point of securement for such lifelines. This situation is of particular importance in the housing construction industry where the building designs either do not allow for or do not provide a secure attachment point.

The present invention is directed toward an apparatus and method whereby a secure lifeline attachment point can be provided for use in building construction, particularly wood frame housing construction. The invention further provides an apparatus and method whereby the attachment point may be used during initial construction as well as for later maintenance and repair of the structure.

The prior art has recognized the problem and various devices and apparatus have been suggested to overcome this deficiency. However, these devices have drawbacks of their own ranging from their complexity to an inadequacy for the particular field of construction. For example, U.S. Pat. No. 5,054,576, issued to Glynn, presents a lifeline safety system which is attached on the outside of a roof and includes a retractable lifeline with a centrifugal locking/rewind mechanism which automatically locks the lifeline upon rapid acceleration such as would be encountered by a worker falling from the roof. While this device may provide adequate safety, it is somewhat expensive and requires maintenance of a complex mechanical aspect of its structure in order to ensure its proper operation. Furthermore, it must be removed following completion of a particular job and, if required again at a later date, it must be reinstalled. U.S. Pat. No. 5,036,949, issued to Crocker, et al., presents an apparatus more suitable to flat surfaces having edges to which C-clamps may be attached as anchors for the securement of a bridle. The worker's personal line is then attached to this bridle by means of a shackle or clevis. Similarly, U.S. Pat. No. 5,092,426, issued to Rhodes, presents an adjustable clamping device for securement to the outside of a substantially flat and rectangular area by clamping against opposite edges. Lifelines attach to the central adjustable body of the device.

Neither of the foregoing patents provides a simple and inexpensive device which meets the requirements of the Occupational Safety and Health Administration for lifeline anchors and which may be installed during initial construction of a building and left in place at completion for later use during roof repair and maintenance.

SUMMARY OF THE INVENTION

It is an object of this invention to provide a roof lifeline anchor which is of simple construction and which is attachable to the roof trusses of a building under construction.

It is a further object of this invention to provide a roof lifeline anchor which provides a safe and secure point for attachment of worker safety lifelines and which meets OSHA requirements.

It is an even further object of this invention to provide a roof lifeline anchor which is securely fixable between adjacent roof trusses beneath the roof undersheathing in such a manner that forces exerted thereon via a lifeline will be directed through and supported by the roof truss assemblies.

It is a still further object of this invention to provide a roof lifeline anchor which is easily installed within a roof structure and which can be left in place after completion of the building.

Further objects and advantages will become evident from the following discussion and drawings.

The present invention provides a roof lifeline anchor for attachment to adjacent roof trusses of a building wherein the anchor comprises an elongate beam having first and second ends, truss attachment means at these first and second ends and lifeline attachment means positioned on the beam substantially midway between the truss attachments and extending perpendicularly to the beam. Alternative truss attachment means are provided which include U-shaped stirrups into which the trusses fit and can be secured, as well as rod members which can be inserted through trusses in the manner of lag bolts with nuts threaded on their ends and tightened against the trusses. Attachment means for the lifelines can be any means which allows tying or otherwise securing a line thereto but which is preferably an eyebolt having a shaft which is fastened to the beam and which projects above the level of the roof. Such eyebolts are preferably attached so that they can be removed when the roof is completed but easily replaced when needed.

DETAILED DESCRIPTION OF THE INVENTION

Occupational Safety and Health Administration rules for lifelines require that they be secured above the point of operation to an anchorage or structural member capable of supporting a minimum dead weight of 5,400 pounds (29 CFR §1926.104(b)). In the case of building construction, this usually means securing lifelines to the more substantial portions of the building framework. In order to be above the point of operation, lifelines are generally attached to the framing members of the roof assemblies. However, without a proper anchor means, secure attachment of a lifeline within the OSHA requirements may not be obtained and damage to the building framework may occur. Of particular interest is the attachment of lifelines for roof workers within the housing construction industry where the majority of roofs are raked from a central ridge downward to the eaves. The rake of such roofs can be of varying degrees from relatively shallow on rambler style houses to fairly steep, such as those found on row houses. The present invention provides an anchor device for roof worker lifelines which can be used on any roof, regardless of its rake. In roof truss systems it is preferred that the load to be placed on a lifeline system be distributed as widely as possible. At a minimum, it should be distributed substantially equally between two trusses. Furthermore, to meet the above noted OSHA requirements, the lifelines must be attached as close to the roof peak or ridge as possible.

Figure 1:
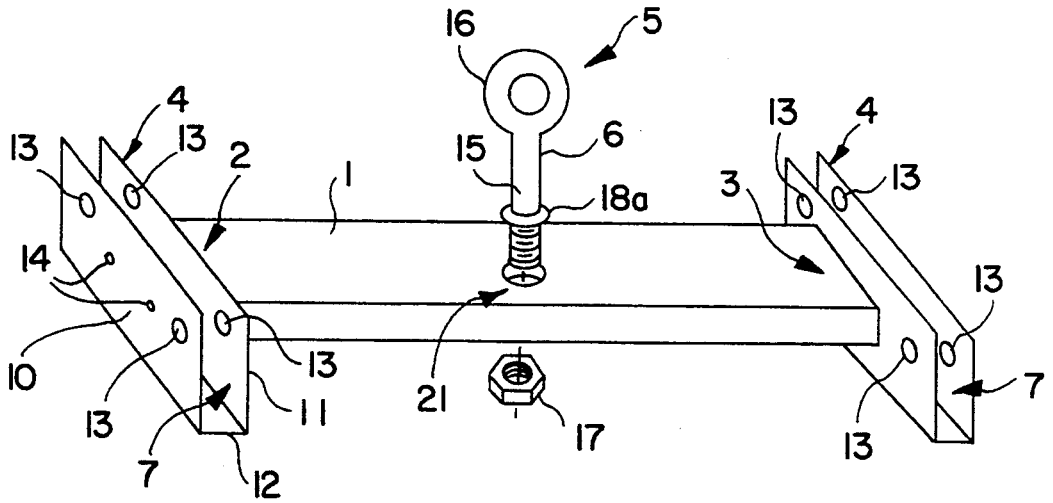
FIG. 1 is an oblique view of the preferred embodiment of the roof lifeline anchor of the invention.
Figure 3:
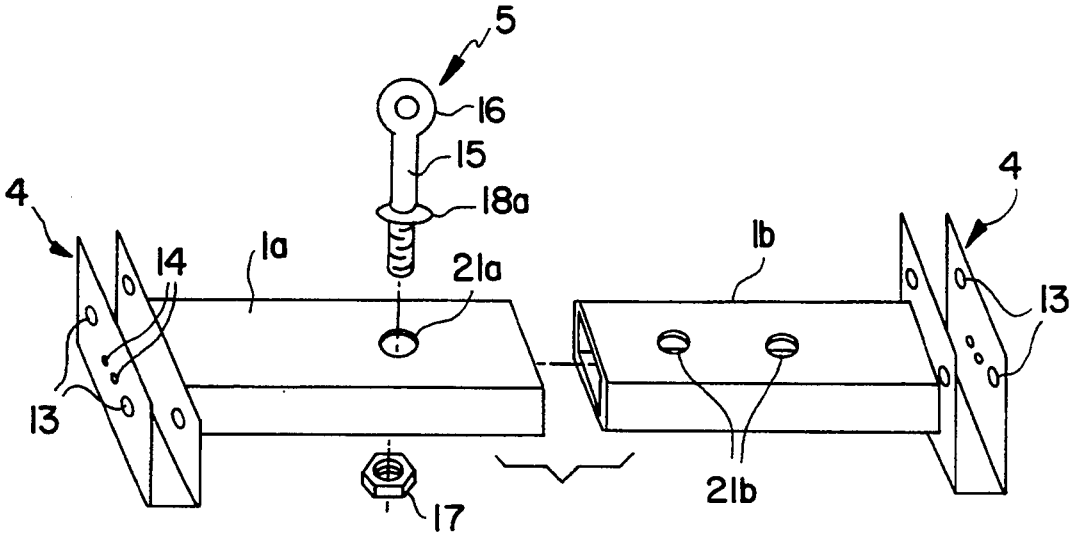
FIG. 3 is an expanded oblique view of the embodiment of FIG. 2.
Figure 4:
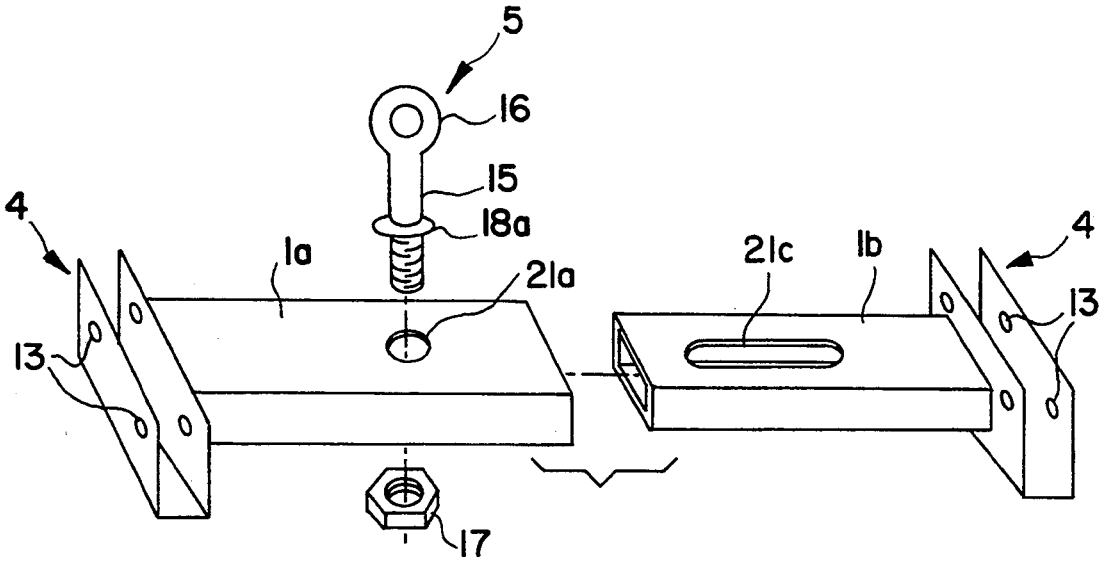
FIG. 4 is an expanded oblique view of a modified form of the embodiment of FIG. 2.

The preferred embodiment of the invention is illustrated in FIG. 1 and comprises an elongate beam 1 having two ends 2, 3 with truss attachments in the form of stirrups 4 at each end. A lifeline attachment means 5 illustrated by eyebolt 6 is positioned on the beam 1 substantially midway between the stirrups 4 and extending perpendicularly to said beam. Beam 1 is preferably a steel box beam fabricated from ¼" to ½" steel and approximately 4" by 2", although it may also be a simple solid beam. Also, other dimensions may be preferred for particular circumstances of building construction and are considered to be included herein. Stirrups 4 are identical and made from ⅛" to ¼" sheet steel bent to shape and welded to the ends 2, 3 of beam 1 such that the upper surface of beam 1 is slightly below the upper edge of the stirrups 4. Alternative materials such as aluminum alloys, composite materials, reinforced polymers and various steel alloys may also be used as long as they provide the strength necessary to meet OSHA. In the case of composites or reinforced polymers, the beam 1 and stirrups 4 may be laid up and formed as a single piece with any reinforcing material running continuously through the beam and stirrups. Beam 1 should be centrally located with respect to the ends of stirrups 4. The outer dimensions of the stirrups 4 are preferably about 9" by 6" with the inner channel 7 of sufficient size to accept the beams 8 of a roof truss assembly 9 as illustrated in FIGS. 3 and 4. Stirrups 4 may be of a different size so long as they will allow truss beams 8 to fit within them.

As shown, stirrups 4 comprise two upstanding walls 10, 11 joined by a bottom wall 12. The open side opposite bottom wall 12 is uppermost when the anchor is constructed so that the device may be lifted into place from the underside of the truss assembly 9 and secured in place. Mounting holes 13 are provided in the walls 10, 11 of stirrups 4 for the insertion of bolts 26 to secure the anchor to the truss beams 8. Nuts **26*a* attach to the ends of bolts 26 by way of cooperating threads. Mounting holes 13 in wall 10 are aligned with mounting holes 13 in wall 11 and also serve as guides for drilling corresponding holes 24 in truss beams 8 for the mounting bolts 26. In order to support the anchor while the truss beam holes 24 are being drilled and the bolts 26 inserted, temporary nail holes 14 are provided in the outer wall 10 of each stirrup 4 so that nails can be driven into the truss beam 8 to temporarily hold the anchor in place. Although bolts 26 and nuts 26*a* are preferred for attachment of the anchor to truss beam 8**, other attachment means such as rivets, spikes, nails, screws and the like may also be used.

Figure 6:
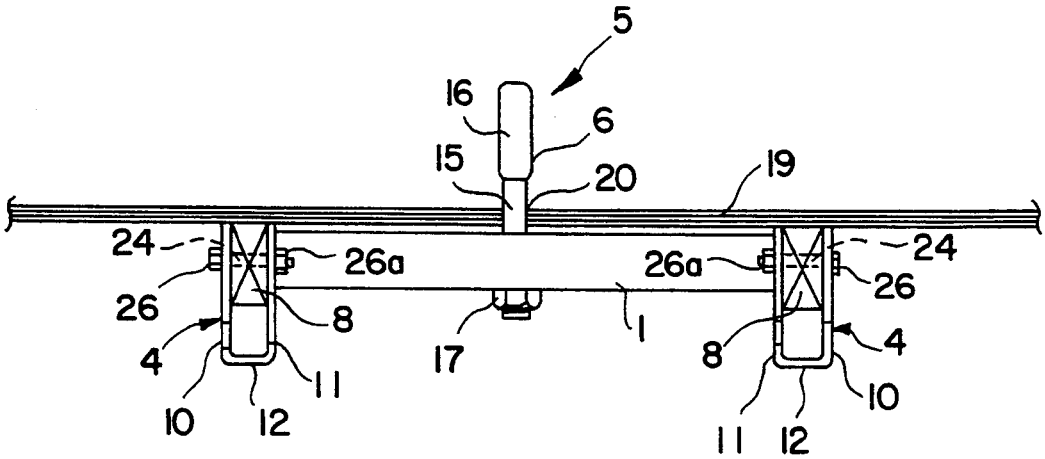
FIG. 6 is a planar edge view of a portion of a roof illustrating the preferred embodiment of the roof lifeline anchor of the invention in place between two truss beams.
Figure 8:
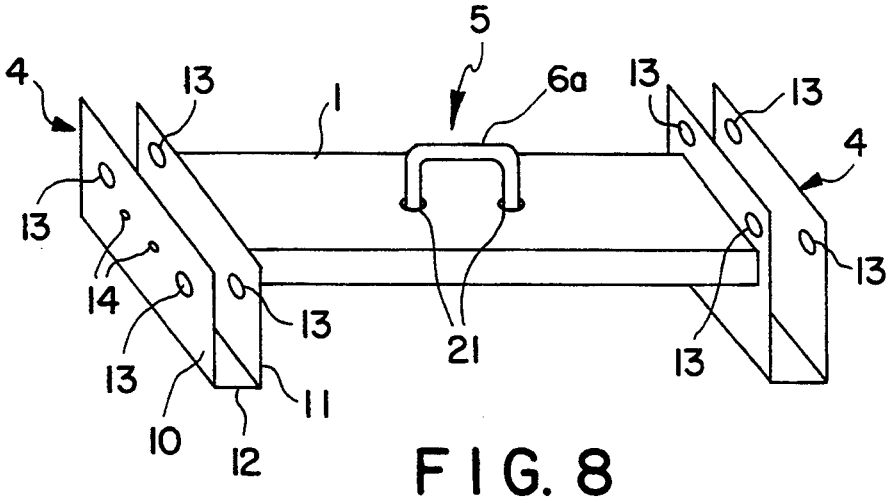
FIG. 8 is an oblique view of a still further alternative embodiment of the roof lifeline anchor of the invention.

The lifeline attachment means 5 is illustrated as an eyebolt 6 comprising a shaft 15 with a ring or eye 16 contiguous therewith. Preferably the eyebolt 6 is forged as a single unit and is attached to beam 1 in a manner so as to be removable therefrom when construction is finished. In this respect, the preferred method of attachment is for the end of eyebolt shaft 15 opposite ring 16 to be inserted through an aperture or hole 21 in beam 1. The end of shaft 15 is threaded and projects through the underside of beam 1 to accept nut 17 as shown in FIGS. 1 and 6. When beam 1 is a hollow box beam, hole 21 is considered to include aligned holes in both the upper and lower walls of beam 1. When beam 1 is solid, hole 21 is preferably a continuous passage through beam 1 perpendicular to the longitudinal axis of beam 1. A second nut 18 may be secured on shaft 15 as a stop means to prevent eyebolt 6 from passing too far through beam 1. Alternatively, a washer **18*a* or flange or similar means welded to or formed as part of shaft 15 may be provided instead of nut 18 as a stop means on shaft 15. As a further alternative, particularly when beam 1 is solid, hole 21 may be threaded to cooperate with the threading on shaft 15 and eyebolt 6 may thereby be threaded directly into beam 1. If it is not considered necessary to have eyebolt 6 removable, it may be permanently welded in place on beam 1. Alternative means may be used for attachment of lifelines to the anchor instead of eyebolt 6. For example, a U bolt or staple 6*a* as shown in FIG. 8 may be used. In such a case the staple 6*a* may be welded to beam 1 or bolted thereto as with eyebolt 6, beam 1 having two holes 21 in it to accommodate both legs of the staple 6*a*. Also, forged rings may be welded directly to beam 1**.

Figure 5:
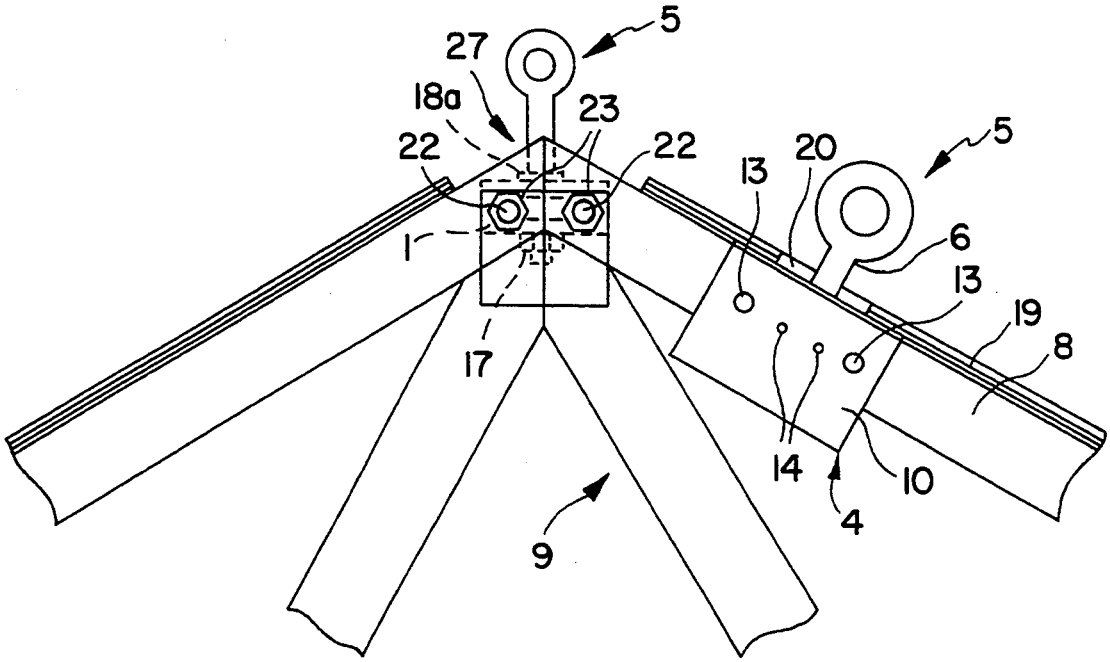
FIG. 5 is a planar end view of a roof truss assembly illustrating the preferred embodiment of the roof lifeline anchor of the invention in place slightly down the slope of the roof and illustrating an alternative embodiment of the roof lifeline anchor of the invention in place at the ridge line of the roof.

Turning to FIGS. 5 and 6, the mounting of the anchor of the invention within a roof structure is shown. As noted above, the anchor is installed from beneath the truss assembly 9, the beams 8 of adjacent truss assemblies 9 fitting into stirrups 4. The anchor is installed so that the upper edges of walls 10, 11 of stirrups 4 are flush with the upper surfaces of truss beams 8. In this manner, beam 1 of the anchor will be positioned below the inner surface of the roof undersheathing 19 as clearly shown in FIG. 6 and neither beam 1 nor stirrups 4 will interfere with the placement and attachment of roof undersheathing 19 on truss beams 8. Lifeline attachment means 5 preferably projects above the level of the undersheathing 19 to permit attachment of lifelines, the undersheathing 19 being installed around lifeline attachment means 5 or provided with an aperture 20 for passage of lifeline attachment means 5. Following completion of the roof construction and removal of eyebolt 6 or staple **6*a*, aperture 20 is easily covered and sealed to prevent leakage by the application of flashing and roof shingles thereover. Other sealing means common to the roofing industry may also be used. Where eyebolt 6 or staple 6***a* is to be left in place, a weatherproof cover may be used to seal aperture 20 or a sealant may be placed therein around shaft 15.

Normal building code practices provide for the installation of roof trusses with a spacing of sixteen inches on center, therefor, the anchor of the invention will normally be of a length such that the stirrups 4 are also spaced apart sixteen inches on center. Some codes or structures may provide for different spacing in which case the anchor of the invention will be constructed so that its length allows stirrups 4 to have the necessary on center spacing. In most cases, building codes specify either sixteen or twentyfour inch on center spacing and an alternative embodiment of the anchor of the invention provides a construction which may be adjusted to accommodate either one of these spacings.

Figure 2:
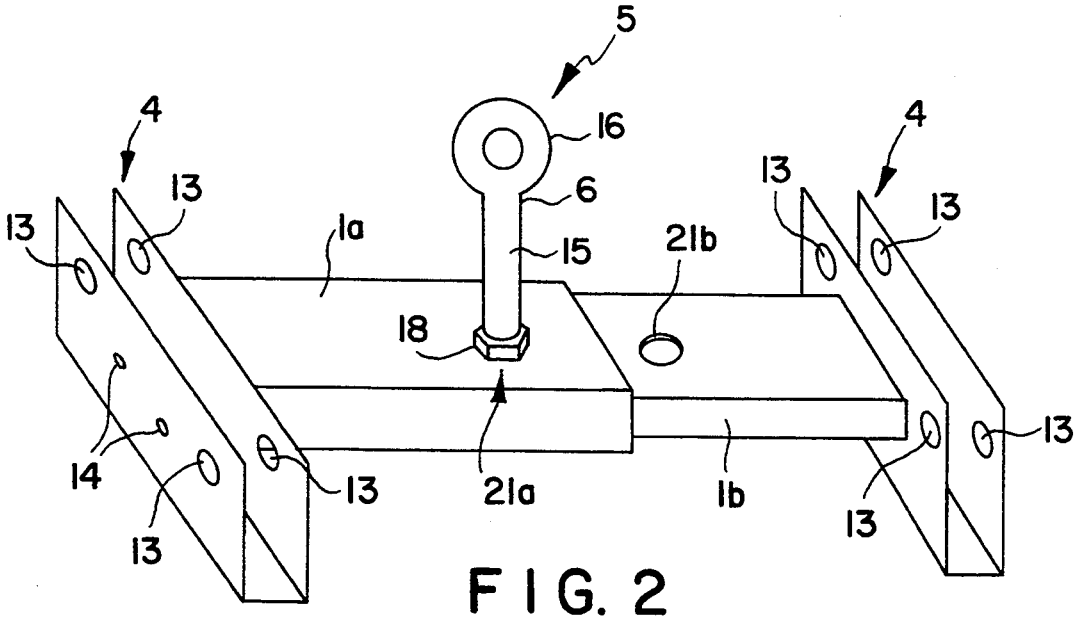
FIG. 2 is an oblique view of an alternative adjustable embodiment of the roof lifeline anchor of the invention.
Figure 4A:
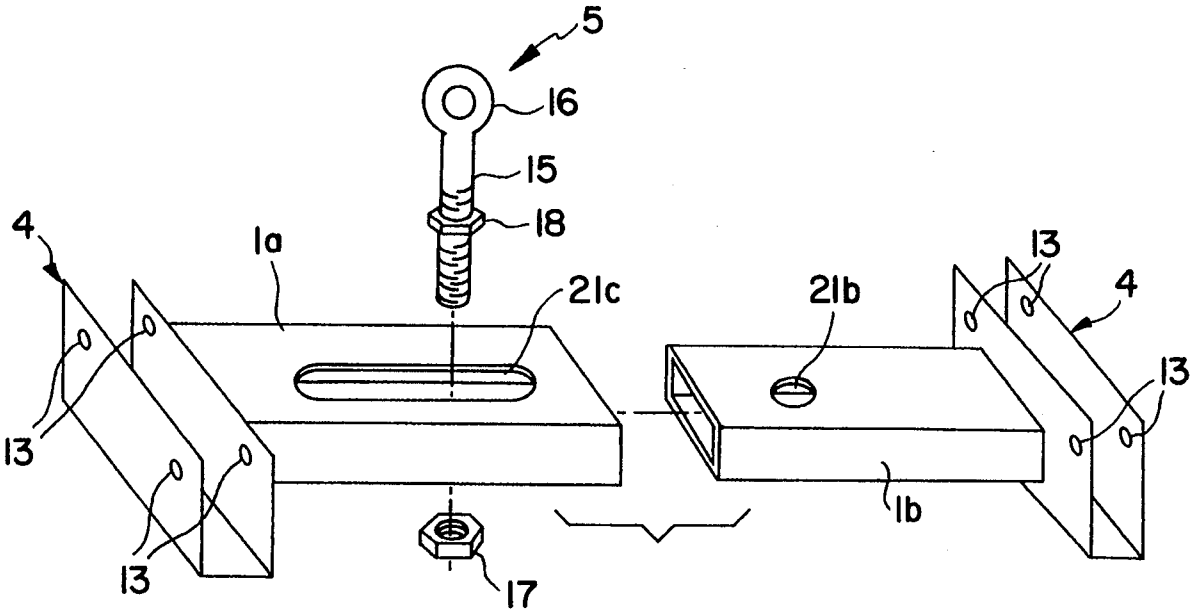
FIG. 4*a* is an alternative form of the modified embodiment of FIG. 4.

FIGS. 2, 3 and 4 illustrate this alternative adjustable embodiment wherein beam 1 comprises two sections 1*a* and 1*b* which are telescopic. In the figure, beam section 1*b* is illustrated as being telescopic into beam section 1*a* therefor at least beam section 1*a* must be hollow. Preferably, both sections 1*a* and 1*b* will be hollow box beams with section 1*a* having a hollow core of a size to accept section 1*b*. Each section 1*a* and 1*b* has a stirrup 4 secured to one end so that when they are assembled the anchor will have a stirrup 4 at each end for attachment to truss beams 8. As with the basic embodiment of FIG. 1, beam section 1*a* is provided with a hole 21*a* through both the upper and lower walls of the section to accept shaft 15 of eyebolt 6. This hole 21*a* is preferably spaced toward the free end of beam section 1*a* but not too close thereto so as to weaken the beam section. Beam section 1*b*, on the other hand, is provided with two holes 21*b*, each through both the upper and lower walls of the beam section, corresponding to positions which will provide that stirrups 4 will be located at sixteen or twentyfour inches on center depending on which hole 21*b* is aligned with hole 21*a*. In this embodiment, alignment of the required hole 21*b* in beam section 1*b* with hole 21*a* in beam section 1*a* and insertion of eyebolt 6 secures the anchor at the desired length. If further adjustability is required additional holes 21*b* may be provided in beam section 1*b*, each hole 21*b* corresponding to a particular on center spacing of truss assemblies 9 in a roof construction. In a still further adjustable alternative illustrated in FIG. 4 holes 21*b* in beam section 1*b* may be elongated and joined to form a single slot 21*c* through upper and lower walls of the section thereby affording this embodiment of the anchor a variable length adjustment between the extreme ends of the slot 21*c*. Eyebolt 6 serves in this form to secure the anchor at the desired length by tightening nut 17. Alternatively, hole 21*a* in beam section 1*a* may be replaced by slot 21*c* and a single hole 21*b* may be provided in beam section 1*b* as shown in FIG. 4*a*. In this alternative, eyebolt 6 will slide in slot 21*c* as section 1*b* is telescoped within beam section 1*a*. Nuts 17 and 18 on shaft 15 are tightened to maintain the desired length adjustment. As with the preferred embodiment of FIG. 1, the adjustable embodiment may be formed from steel, aluminum, alloys thereof or composite materials so long as the material used meets the load requirements dictated by OSHA.

Figure 7:
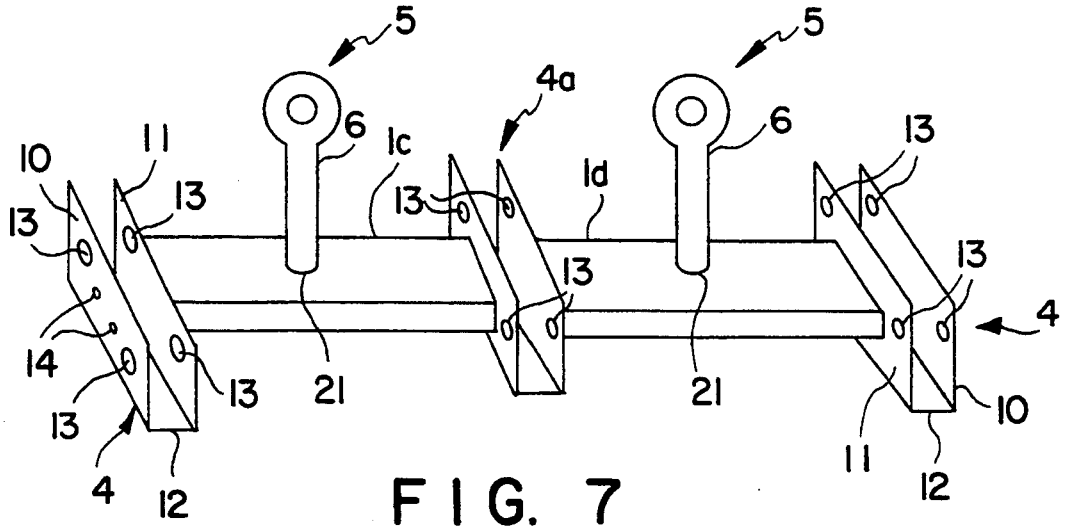
FIG. 7 is an oblique view of a further alternative embodiment of the roof lifeline anchor of the invention.

A further alternative form of the anchor is illustrated in FIG. 7. This embodiment illustrates how the device may be constructed to provide multiple lifeline anchor points. As illustrated, the anchor comprises two beams 1*c*, 1*d* and three stirrups 4, the central stirrup being designated 4*a*. The stirrups 4, 4*a* are identical to stirrups 4 of the embodiment of FIG. 1 with the exception that stirrup 4*a* need not have temporary nail holes 14. Beams 1*c* and 1*d* are separated by stirrup 4*a*, each beam 1*c*, 1*d* being attached to an upstanding wall 10 or 11 of stirrup 4*a* such that a double anchor is produced with the spacing between stirrups 4, 4*a* corresponding to the required code spacing of roof trusses 9. Each beam 1*c*, 1*d* is provided with the appropriate hole 21 in which is mounted lifeline attachment means such as eyebolt 6 or staple 6*a*. This multiple anchor may also be made adjustable in the same manner as the adjustable embodiment of FIGS. 2, 3, 4 and 4*a*.

This embodiment is attached to the roof trusses 9 in the same manner as the embodiments of FIGS. 1 and 2. The anchor assembly is raised into place from within the roof area between three adjacent truss assemblies 9 so that stirrups 4, 4*a* engage truss beams 8 in the manner shown in FIG. 6. Lifeline attachment means 5 represented by eyebolt 6 or staple 6*a* extend upward between the adjacent trusses 9 and through the undersheathing 19. As with the other embodiments, mounting bolts 26 are used to secure the anchor to the truss beams 8 via mounting holes 13 and corresponding holes drilled through truss beams 8. Theoretically, any number of beams and stirrups may be combined in this manner to provide as many anchor points as are needed. However, from a practical standpoint, most construction projects will require only one or two such points and may be served by anchors constructed according to the embodiments of FIGS. 1, 2 or 7.

Figure 9:
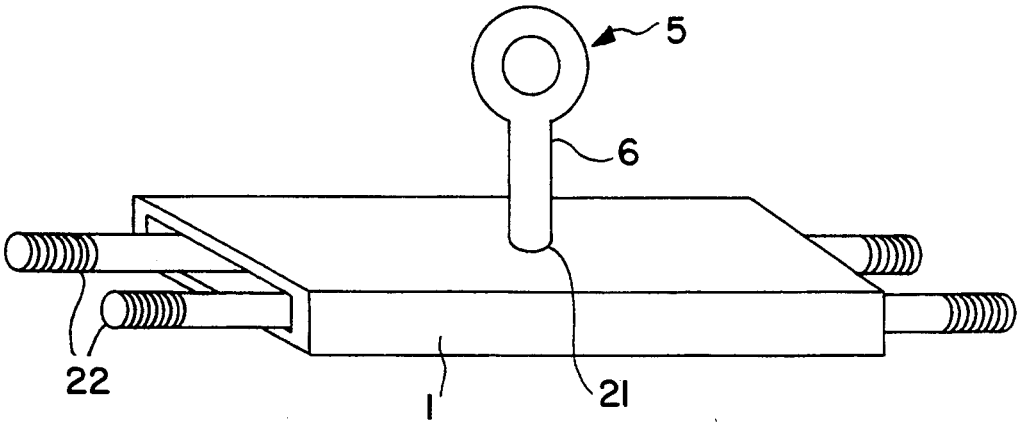
FIG. 9 is an oblique view of an alternative embodiment of the roof lifeline anchor of the invention illustrating an alternative truss attachment means.
Figure 10:
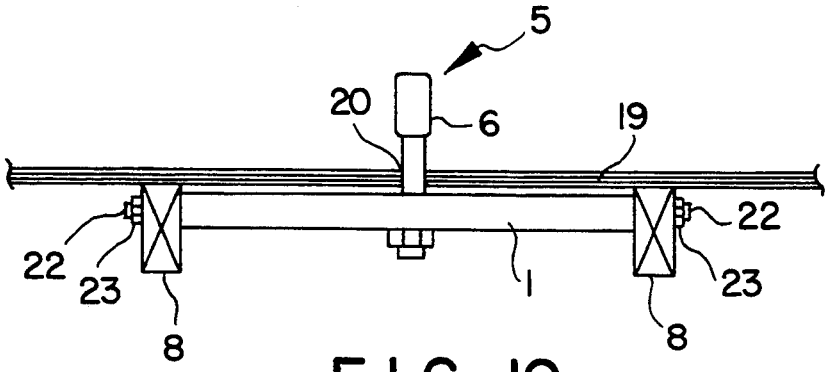
FIG. 10 is a planar edge view of a portion of a roof construction illustrating the roof lifeline anchor embodiment of FIG. 9 in place between two truss beams.
Figure 11:
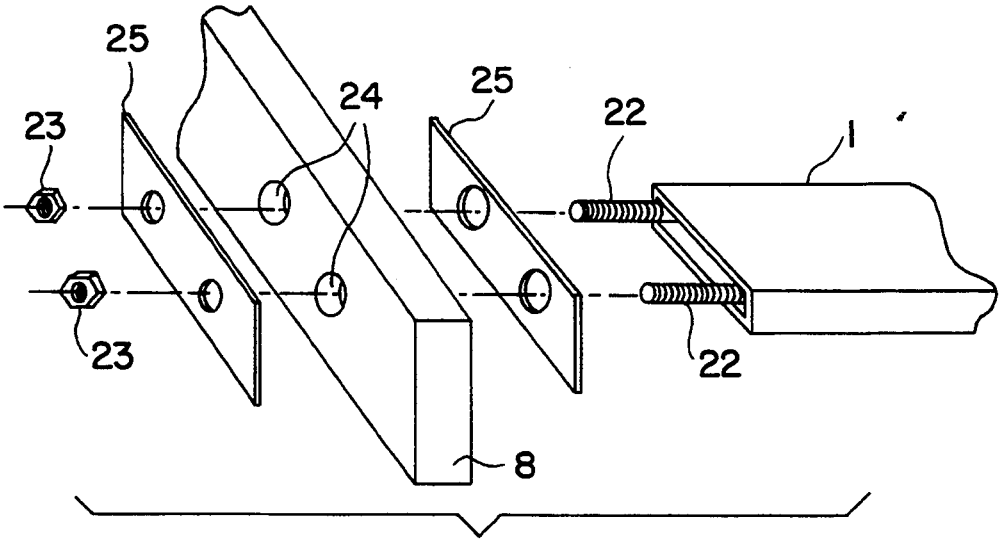
FIG. 11 is an expanded oblique view of one end of the embodiment of FIG. 9 illustrating the relationship of its attachment to a truss beam.

FIGS. 9, 10 and 11 illustrate a further alternative construction of the anchor which employs a different truss attachment means than stirrups. In this embodiment, beam 1 is a hollow box beam as before and lifeline attachment means 5 is represented by eyebolt 6 inserted into hole 21 at the approximate center of beam 1. Attachment to the truss beams 8 is provided by means of two elongated rods 22 which pass longitudinally through the hollow core of beam 1 and extend beyond each end of beam 1 a distance which is sufficient to pass through adjacent truss beams 8 and accept fastening nuts 23. The ends of rods 22 are threaded to correspond to threading of the nuts 23. Rods 22 are preferably steel and of sufficient rigidity so as not to allow excessive flexing. Furthermore, the height dimension of the hollow core of beam 1 is preferably only slightly greater than the diameter of rods 22 thereby adding to the rigidity of the assembly. The width of the core of beam 1 is sufficient to accommodate the rods 22 with the shaft of lifeline attachment means 5 passing through beam 1 therebetween. The length of beam 1 in this embodiment is based on the space between adjacent truss beams 8 and will be calculated from the on center spacing specified by the building code minus an amount equivalent to the thickness of one truss beam 8. In this manner beam 1 will fit between adjacent truss beams 8 as shown in FIG. 10. As with the previous embodiments, lifeline attachment means 5 represented by eyebolt 6 is attached to beam 1 and passes upward through hole 20 provided in undersheathing 19. After completion of the roof construction, eyebolt 6 may be removed and hole 20 covered with flashing and roofing shingles.

FIG. 11 shows the manner in which the anchor of this embodiment is attached to the truss beams 8. Mounting holes 24 are drilled into truss beam 8 at the same spacing as rods 22. Bearing plates 25 are provided for each side of truss beam 8 to provide a surface against which the end face of beam 1 and nuts 23 can be tightened. Bearing plates 25 are preferably steel with predrilled holes spaced to permit passage of rods 22 and may also be used as templates to drill the mounting holes 24 in truss beams 8. As with the anchor itself, alternative materials may be used for the bearing plates 25 and, as a further alternative, standard washers may be used instead of the plates 25. This embodiment will preferably be installed in the roof structure as the trusses 9 are put in place. One end of rods 22 will be inserted into holes in a first truss beam 8 and the next truss assembly 9 raised into place onto the other end of rods 22 thereby trapping beam 1 between the adjacent truss beams 8. During this construction, bearing plates 25 or, alternatively washers, will be installed between the ends of beam 1 and truss beams 8 and between truss beams 8 and nuts 23. This embodiment is particularly well suited to application at the ridge of a roof whereby the lifeline attachment means 5 may project through the space left for the ridge vent 27 as shown in FIG. 5.

Other alternative truss attachment means may be considered for any of the embodiments of the invention so long as they provide the necessary physical securement of the device to the roof truss assemblies and meet the 5400 pound test requirements of OSHA.

The foregoing disclosure presents the preferred embodiments of the roof lifeline anchor of the present invention. Further alternatives and modifications which may be evident to those of skill in the art are deemed to be within the scope of the accompanying claims.

What is claimed is:

1. A roof lifeline anchor for attachment to and between adjacent roof trusses of a building, comprising an elongate beam having first and second ends, truss attachment means at said first and second ends and lifeline attachment means positioned on said beam substantially midway between said first and second ends, wherein said truss attachment means comprises elongated stirrups each having a bottom wall and two upstanding parallel spaced side walls to receive said roof trusses and further comprising means to attach said members to said trusses.

2. The roof lifeline anchor of claim 1 wherein said stirrups are secured to said first and second ends of said beam perpendicular to the longitudinal axis thereof.

3. The roof lifeline anchor of claim 2 wherein said stirrups extend horizontally and substantially equidistantly on either side of said beam.

4. The roof lifeline anchor of claim 3 wherein said lifeline attachment means is located on the side of said beam opposite said bottom walls of said stirrups.

5. The roof lifeline anchor of claim 4 wherein said lifeline attachment means comprises an eyebolt having an elongated shaft, a contiguous ring member on one end of said shaft and means on the other end of said shaft to secure said eyebolt to said beam.

6. The roof lifeline anchor of claim 5 wherein said beam has an aperture therethrough perpendicular to the longitudinal axis in which said eyebolt shaft is inserted.

7. The roof lifeline anchor of claim 6 wherein said means to secure said eyebolt to said beam comprises welding said other end of said shaft to said beam.

8. The roof lifeline anchor of claim 6 wherein said means to secure said eyebolt to said beam comprises a nut assembled to said other end of said shaft following insertion of said shaft through said aperture, said nut and said shaft having cooperating threads said nut being larger than said aperture.

9. The roof lifeline anchor of claim 6 wherein said means to secure said eyebolt to said beam comprises cooperating threads within said aperture and on said eyebolt shaft.

10. The roof lifeline anchor of claim 1 wherein said lifeline attachment means comprises a U-shaped member secured to said beam.

11. The roof lifeline anchor of claim 6 comprising first and second elongate beams joined along a common longitudinal axis by one stirrup placed therebetween, each beam having a further stirrup attached to its free end.

12. A roof lifeline anchor for attachment to and between adjacent roof trusses of a building and comprising an elongate beam having first and second ends, roof truss attachment means, and lifeline attachment means located midway between said first and second ends; wherein said beam comprises a box beam having a longitudinally hollow core and said lifeline attachment means comprises an eyebolt secured to said beam and extending perpendicularly thereto and wherein said roof truss attachment means comprise U-shaped stirrups secured to each end of said beam and extending perpendicularly thereto; said stirrups comprising elongated channels each adapted to accept a roof truss beam therein and further comprising means to secure said roof lifeline anchor to said trusses.

13. The roof lifeline anchor of claim 12 wherein said means to secure said anchor to said trusses comprises cooperatively threaded nut and bolt sets and holes in said stirrups and said truss beams alignable to accept said nut and bolt sets.

14. A roof lifeline anchor for attachment to and between adjacent roof trusses of a building and comprising an elongate beam having first and second ends, roof truss attachment means, and lifeline attachment means located midway between said first and second ends; wherein said beam comprises a box beam having a longitudinally hollow core and said lifeline attachment means comprises an eyebolt secured to said beam and extending perpendicularly thereto and wherein said roof truss attachment means comprise at least two steel rods passing longitudinally through said hollow core of said beam and extending beyond each end of said beam a length sufficient to pass through adjacent roof truss beams and to accept securing means thereon.

15. The roof lifeline anchor of claim 14 wherein said beam has a length equal to the distance between adjacent roof trusses.

16. The roof lifeline anchor of claim 15 further comprising threading on the ends of said rods and cooperatively threaded nuts therefor whereby said anchor may be secured to said trusses by passage of said rods through said truss beams and application of said nuts to said ends of said rods, said nuts comprising said securing means.

17. The roof lifeline anchor of claim 16 further comprising bearing surface means positionable on said rods so as to be interposed between said beam and said trusses and between said nuts and said trusses and thereby provide a bearing surface against said trusses.

18. The roof lifeline anchor of claim 17 wherein said bearing surface means comprises standard flat washers placed on said rods.

19. The roof lifeline anchor of claim 17 wherein said bearing surface means comprises substantially rectangular plate members having holes therein positioned for passage of said rods.

20. A roof lifeline anchor for attachment to and between adjacent roof trusses of a building comprising a first elongated hollow beam having a roof truss attachment means on one end, a second elongated beam having a first end telescopic within said first beam and having a roof truss attachment means on a second end, each beam having apertures perpendicularly therethrough, the apertures of said second beam being alignable with the apertures of said first beam, and a lifeline attachment means adapted to be inserted into said apertures when aligned and be secured therein whereby said first and second beams are maintained in a specific telescopic relationship and wherein said roof truss attachment means comprises elongated stirrups each having a bottom wall and two upstanding parallel spaced side walls to receive said roof trusses and further comprising means to attach said members to said trusses.

21. The roof lifeline anchor of claim 20 wherein said apertures of said first and second beams are alignable at fixed positions and said lifeline attachment means comprises an eyebolt adapted to be bolted through said apertures when aligned to thereby fix the length of said anchor to correspond to predetermined spacing between said roof trusses.

22. The roof lifeline anchor of claim 20 wherein said first beam is provided with a single aperture and said second beam is provided with at least two spaced apertures, said first and second beams being relatively telescopic to align said first beam aperture with a select one of said at least two second beam apertures, said lifeline attachment means being inserted through said aligned apertures and secured therein to fix the length of said anchor.

23. The roof lifeline anchor of claim 20 wherein said second beam aperture comprises an elongated slot whereby said first and second beams are alignable at various telescopic positions between the ends of said slot.

24. The roof lifeline anchor of claim 20 wherein said first beam aperture comprises an elongated slot whereby said first and second beams are alignable at various telescopic positions between the ends of said slot.

* * * * *